US006718716B2

(12) United States Patent
Cowie

(10) Patent No.: US 6,718,716 B2
(45) Date of Patent: Apr. 13, 2004

(54) THERMAL INSULATION PAD

(76) Inventor: Graham Cowie, P.O. Box 69, Brooklyn, Queens County Novia Scotia (CA), B0J 1H0

( * ) Notice: Subject to any disclaimer, the term of this patent is extended or adjusted under 35 U.S.C. 154(b) by 190 days.

(21) Appl. No.: 10/006,144

(22) Filed: Dec. 10, 2001

(65) Prior Publication Data

US 2003/0106668 A1 Jun. 12, 2003

(51) Int. Cl.[7] ..... E04B 1/74

(52) U.S. Cl. ..... 52/404.1; 52/204.1; 52/403.1; 52/406.2; 428/43; 428/74; 428/77

(58) Field of Search ..... 52/204.1, 403.1, 52/406.2, 404.1; 428/43, 74, 77

(56) References Cited

U.S. PATENT DOCUMENTS

| | | | | |
|---|---|---|---|---|
| 2,342,839 A | | 2/1944 | Byers | 154/44 |
| 2,781,820 A | | 2/1957 | Rogers | 154/28 |
| 3,050,232 A | | 8/1962 | Sutherland | 229/40 |
| 4,204,373 A | | 5/1980 | Davidson | 52/204 |
| 4,335,550 A | | 6/1982 | Johnson | 52/99 |
| 5,092,092 A | | 3/1992 | Kiekens et al. | 52/403 |
| 5,119,605 A | | 6/1992 | Sieber | 52/60 |
| 5,532,034 A | * | 7/1996 | Kirby et al. | 428/69 |
| 5,552,205 A | * | 9/1996 | Lea | 428/74 |
| 5,765,318 A | * | 6/1998 | Michelsen | 52/98 |
| 5,948,505 A | | 9/1999 | Puppin | 428/121 |
| 6,042,911 A | | 3/2000 | Berdan, II | 428/36.3 |
| 6,221,464 B1 | * | 4/2001 | Patel et al. | 428/192 |

FOREIGN PATENT DOCUMENTS

| | | |
|---|---|---|
| DE | 3402377 | 8/1985 |
| FR | 2383282 | 10/1978 |
| JO | 3176554 | 7/1991 |

* cited by examiner

*Primary Examiner*—Carl D. Friedman
*Assistant Examiner*—Steve Varner
(74) *Attorney, Agent, or Firm*—Mario Theriault

(57) ABSTRACT

The thermal insulation pad has a compressible insulation strip, a top flexible cover and a bottom flexible cover. A stapling flange and a flashing flange extend widthwise from the top and bottom cover strips respectively along a first side of the insulation strip and are sealed to each other along a bond line near the first side. An interior flange extends widthwise from the top cover strip, along the other side of the insulation strip. The flanges are usable to seal the thermal insulation pad against the weather and air barrier on the outside of a building wall and against the vapour barrier on the inside of a building wall. The flanges extending from the top cover strip are usable to stretch the top cover strip over the insulation strip to form a cushioned liner around a wall opening.

20 Claims, 4 Drawing Sheets

THERMAL INSULATION PAD

FIELD OF THE INVENTION

This invention pertains to preformed thermal insulation products and more particularly, it pertains to thermal insulation pads for sealing the gap space around window and door frames.

BACKGROUND OF THE INVENTION

For ease of installation of a door or window, a gap space of about ¼ to ¾ of an inch is provided between the door or window frame and the wall opening in which it is installed. This gap space is normally insulated after the door or window is installed. Because this gap space is relatively thin, the insertion of insulation material therein is somewhat difficult and often inconsistent, as it is done by forcing loose insulation material into the gap space with the blade of a tool. This is often effected with too much compression or sometimes with not enough compression, resulting in improper insulation.

This problem has been partly addressed in the past and particularly, in the U.S. Pat. No. 4,204,373, issued to James D. Davidson on May 27, 1980. The invention described in this patent consists of a taped and compressed insulation strip which is mounted around a window or door frame. A rip cord is used to rip the tape after the installation of the window or door in a wall opening, causing the insulation to expand and fill the gap space between the window or door frame and the wall opening.

Although the taped and compressed insulation strip of the prior art deserves undeniable merits, it is believed that there continues to be a need for a new and improved thermal insulation pad which can be cut to different lengths and which is easy to work with. It is believed that there continues to be a need for a thermal insulation pad which is mountable into a wall opening prior to the installation of the window or door frame therein, and which can provide a continuous seal between the window or door frame and the weather and vapour barriers of the building.

SUMMARY OF THE INVENTION

The thermal insulation pad according to the present invention is preformed to fit common wall thicknesses, and can be precut to fit specific wall openings. It has sealing flanges to prevent the infiltration of air under the weather and air barrier, and the vapour barrier of a wall. The thermal insulation pad according to the present invention forms a smooth cushioned liner around a wall opening on which a window or a door frame is easily slid during its installation. The thermal insulation pad is made of compressible material for evenly filling and insulating the gap space between a window or door frame and the wall opening.

In accordance with one feature of the present invention, the thermal insulation pad comprises a compressible insulation strip having a rectangular cross-section, a top surface, a bottom surface, a first and second opposite sides; and a flexible top cover strip covering the top surface, and a flexible bottom cover strip covering the bottom surface. The thermal insulation pad also has a flashing flange extending widthwise from the top cover strip, from the first side, and an interior flange extending widthwise from the top cover strip, from the second side.

The thermal insulation pad is mountable as a liner around a wall opening with the flashing flange affixed to the outside surface of the wall and the interior flange affixed to the inside surface of the wall. The thermal insulation pad is mountable as a cushion liner inside a wall opening, wherein the surface thereof is stretched from the compressible insulation strip, to provide a smooth cushioned sliding surface on which a window or door frame can be slid during the installation thereof in the wall opening, to facilitate its installation.

In another aspect of the present invention, the thermal insulation pad also has a stapling flange extending widthwise from the bottom cover strip, from the first side. The stapling flange and the flashing flange are usable to enclose the edge of a weather and air barrier around a wall opening to prevent the infiltration of air under the weather and air barrier. Furthermore, the stapling flange and the flashing flange are sealed to each other along a bond line adjacent the insulation strip to prevent the infiltration of moisture from under the flashing flange and into the insulation strip, in cases where such moisture may occasionally seep under the flashing flange.

In yet another aspect of the present invention, the thermal insulation pad has lines printed thereon to facilitate the cutting of the pad according to the dimensions of a wall opening.

In yet a further aspect of the present invention, adhesive strips are provided on the stapling flange and on the interior flange to seal the thermal insulation pad to the weather and air barrier on the outside of a building and to the vapour barrier inside the building.

In accordance with yet another aspect of the present invention, the thermal insulation pad has one or more transverse notches therein for defining one or more shim pockets in the gap space for easy installation of shims to level or secure a door frame for example.

Still another feature of the thermal insulation pad of the present invention is that it is susceptible of a low cost of manufacture with regard to both materials and labour, and which accordingly is then susceptible of a low price of sale to the consumer, thereby making such thermal insulation pad economically available to the public.

Other advantages and novel features of the present invention will become apparent from the following detailed description of the preferred embodiment.

BRIEF DESCRIPTION OF THE DRAWINGS

Three different embodiments of the present invention are illustrated in the accompanying drawings, in which like numerals denote like parts throughout the several views, and in which.

DETAILED DESCRIPTION OF THE PREFERRED EMBODIMENT

Figure 1:
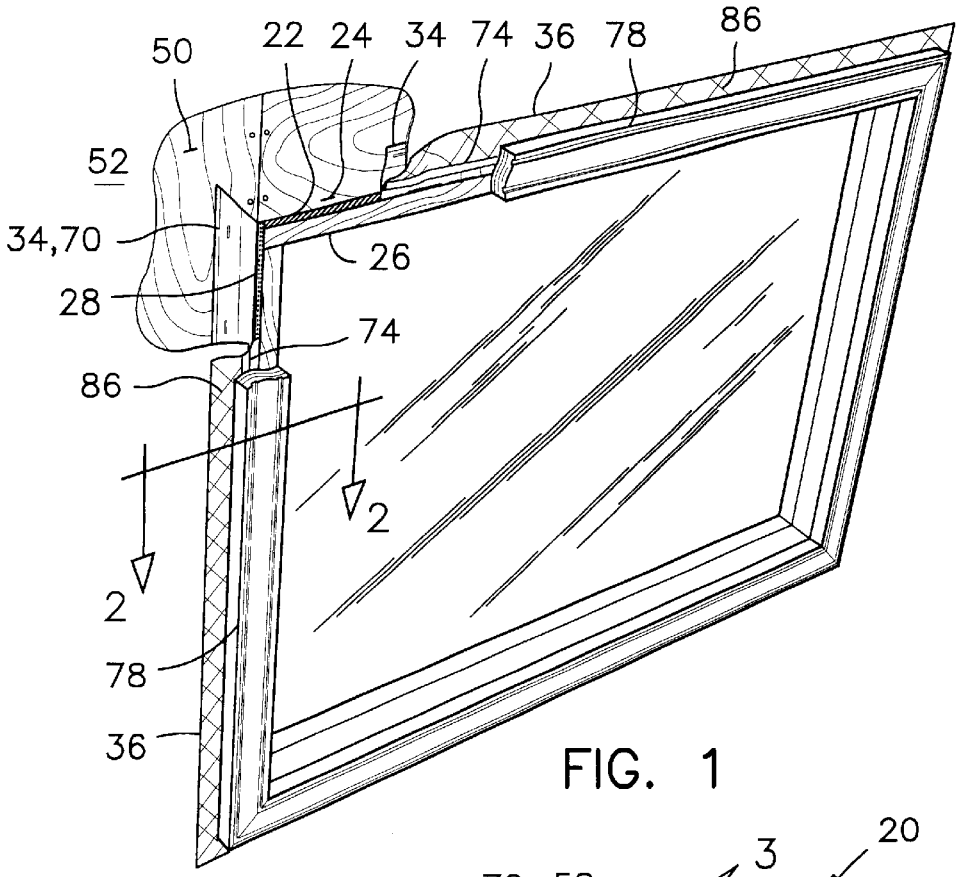
FIG. 1 is a partial view of a window frame in which the thermal insulation pad according to the first preferred embodiment is mounted.

While this invention is susceptible of embodiment in many different forms, there is shown in the drawings and will be described in details herein three specific embodiments, with the understanding that the present disclosure is to be considered as examples of the principles of the invention and is not intended to limit the invention to the embodiments illustrated.

Referring firstly to FIGS. 1–7, the thermal insulation pad 20 according to the first preferred embodiment will be described. The thermal insulation pad 20 is used to fill the gap space 22 between a wall opening 24 and a window frame 26. The thermal insulation pad 20 comprises a strip of compressible insulation 28 such as fibreglass or batting insulation, enclosed between atop and bottom strips of covering material. The top and bottom strips of covering material are labelled as 30 and 32 respectively.

The preferred compressible insulation strip 28 has a rectangular cross-section, a width 'A' corresponding to the wall thickness in which the insulation pad is to be installed, normally 5-½ to 6 inches on modem constructions, and an uncompressed thickness 'B' of about ¾ of an inch.

The strips of covering material 30,32 are preferably made of strong, flexible, weather-resistant paper such as the type known in the construction industry under the trade name TYPAR™. It will be appreciated that plastic or a flexible fabric material having weather-resistance properties can also be used. Both strips of covering material 30,32 are glued to the compressible insulation strip 28 in a known manner.

Figure 4:
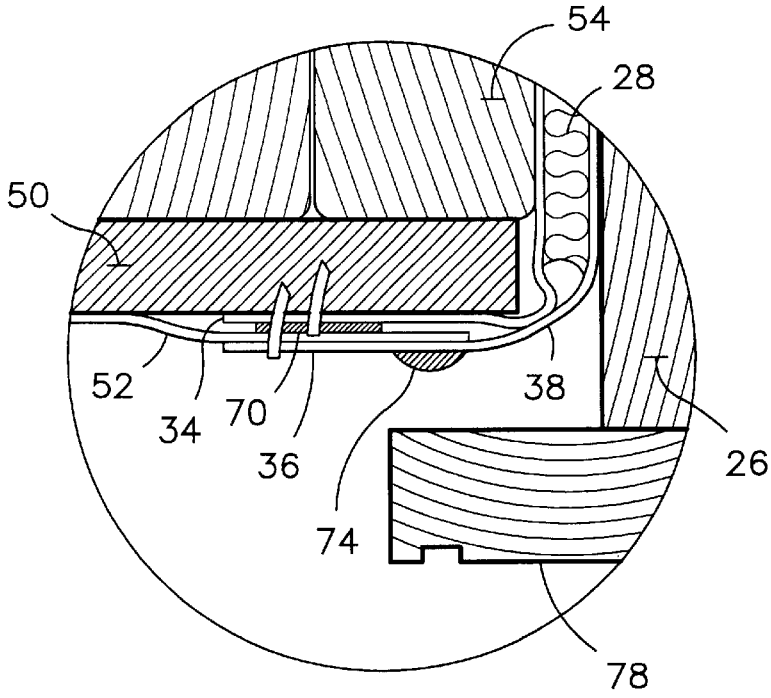
FIG. 4 is an enlarged view of the cross-section details shown in the detail circle 4 in FIG. 2.
Figure 7:
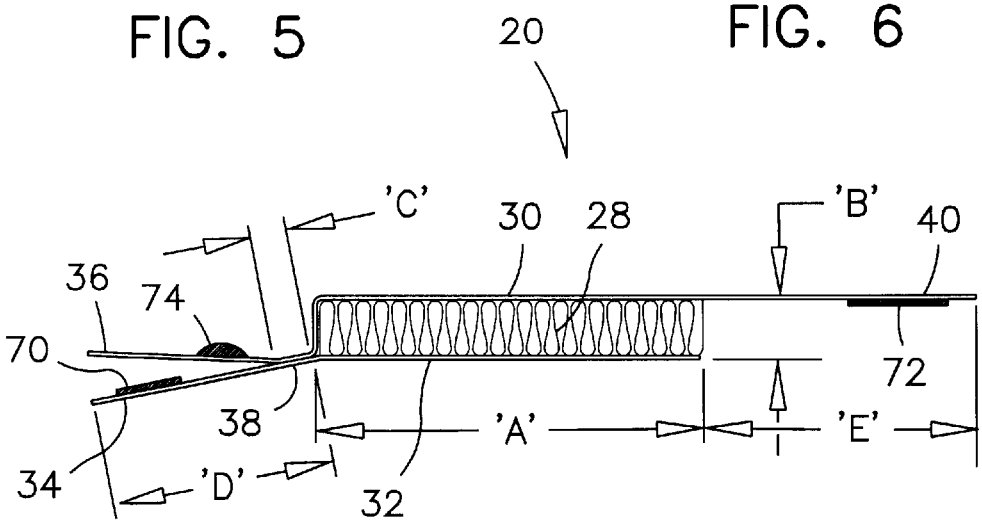
FIG. 7 is the end view of the thermal insulation pad according to the first preferred embodiment.

The bottom cover strip 32 extends widthwise along one side of the compressible insulation strip 28 to form a stapling flange 34. The top cover strip 30 also extends widthwise along the same side to form a flashing flange 36 over the stapling flange 34. Both the stapling flange 34 and the flashing flange 36 are glued to each other along a bond line 38 having a width 'C' of about one half inch, adjacent the insulation strip 28, as illustrated in FIGS. 4, and 7. Both the stapling flange 34 and the flashing flange 36 extend in a spaced-apart relationship from the bond line 38. The bond line 38 provides a seal to prevent the infiltration of moisture into the insulation strip 28, which moisture may occasionally seep between the stapling flange 34 and the flashing flange 36. The top cover strip 30 extends widthwise along the other side of the compressible insulation strip 28 to form an interior flange 40.

Figure 2:
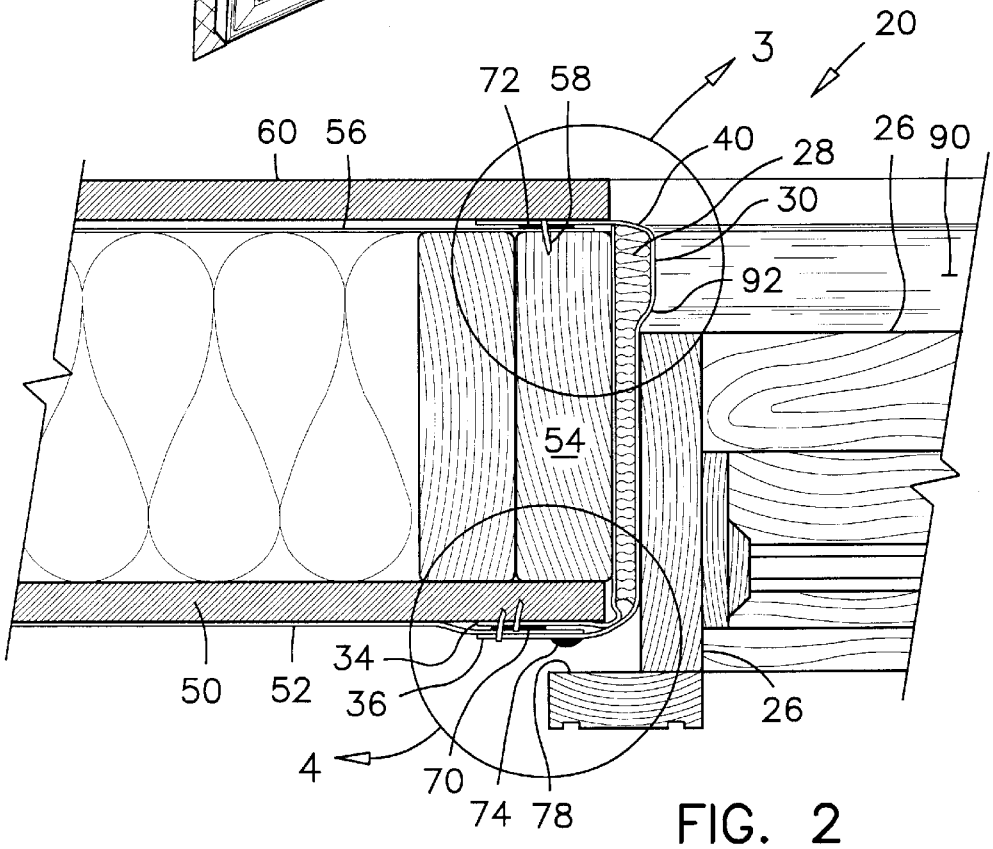
FIG. 2 is a partial cross-section view of the window frame along line 2—2 in FIG. 1.
Figure 3:
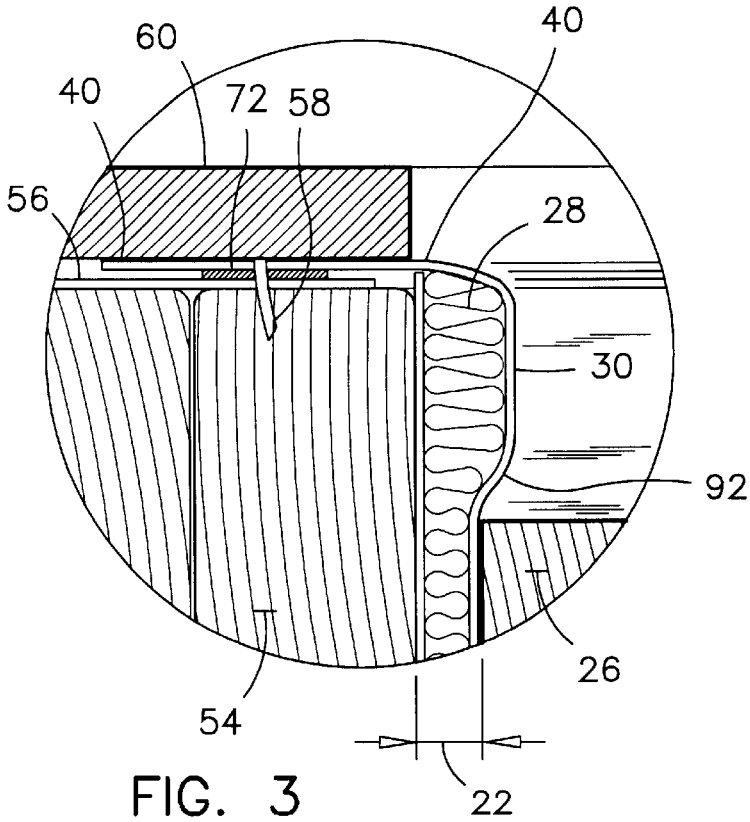
FIG. 3 is an enlarged view of the cross-section details shown in the detail circle 3 in FIG. 2.

The width 'D' of the stapling flange 34 and of the flashing flange 36, as well as the width 'E' of the interior flange are at least about 1-½ to 2 inches, such that these flanges can be wrapped around and over the sides of the framing member 54, as illustrated in FIGS. 2–4.

In use, the stapling flange 34 is stapled to the exterior sheathing 50, or to the outdoor side of the wall. The weather and air barrier 52 is inserted between the stapling flange 34 and the flashing flange 36, and the flashing flange 36 may also be stapled to the exterior sheathing 50. The top cover strip 30 extends to enclose the compressible insulation strip 28 over the wall stud 54, with the interior flange 40 extending over the interior vapour barrier 56. The interior flange 40 is also retained to the indoor side of the wall frame by means of staples 58. In conventional building constructions, a wallboard 60 covers the interior flange 40. The sealing of the thermal insulation pad 20 to the weather and air barrier 52 and to the interior vapour barrier 56 prevents the infiltration of air along these barriers.

In order to further prevent the infiltration of air around a window or a door frame, the stapling flange 34 preferably has an adhesive strip 70 on its surface facing the flashing flange 36. This adhesive strip 70 is preferably a type having a peeled-off protective paper strip, which is removed during the installation of the thermal insulation pad 20.

A similar peeled-off adhesive strip 72 is also preferably affixed to the inside surface of the interior flange 40 for the purpose of sealing the interior flange to the vapour barrier 56. A bead of caulking 74 is applied to the outside surface of the flashing flange 36 and is covered by a peeled-off protective paper strip 76 until installation of the window or door frame 26 in the opening 24. The bead of caulking 74 is positioned to align with the moulding 78 surrounding the window or door frame 26 for sealing the window or door frame 26 to the flashing flange 36.

The thermal insulation pad 20 is preferably manufactured and sold in lengths which are convenient for use without waste in the building construction industry. It can also be manufactured and sold in rolls.

Figure 5:
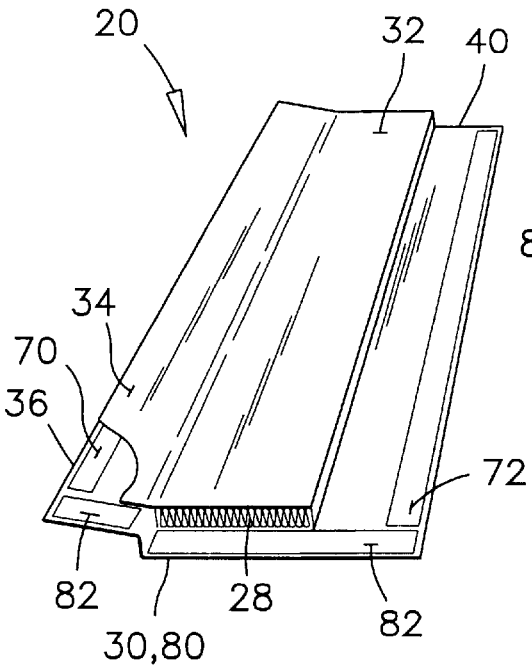
FIG. 5 is a perspective bottom view of the thermal insulation pad according to the first preferred embodiment.

Referring to FIG. 5, an end flap 80 is preferably provided at one end of the thermal insulation pad 20 to overlap an adjacent pad when joining two pads end to end. Adhesive strips 82 are also preferably provided on the end flap 80 to positively retain and seal two insulation pads to each other.

Figure 6:
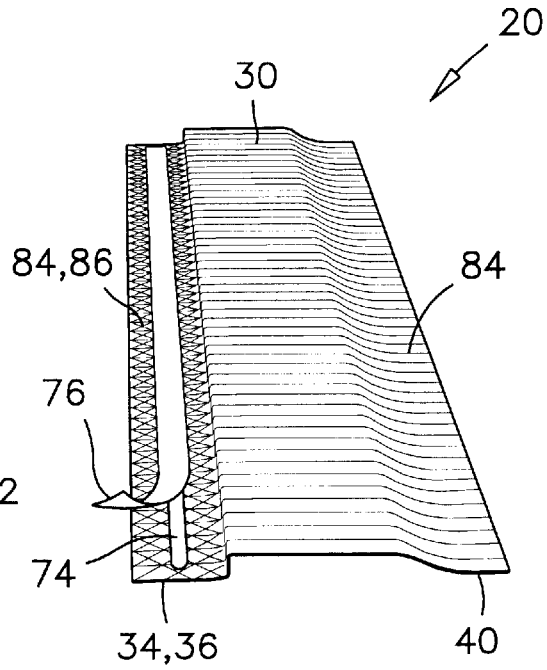
FIG. 6 is a perspective top view of the thermal insulation pad according to the first preferred embodiment.

Referring now specifically to FIGS. 1 and 6, the outside surface of the top cover strip 30 has cut lines printed thereon for assisting in cutting the insulation pad 20 to a proper length. The preferred cut lines comprises transverse cut lines 84 extending perpendicular to the length of the pad 20 and diagonal cut lines 86 on the flashing flange 36, extending at a forty-five degree angle with the length of the pad 20. The cut lines 84, 86 are preferably spaced apart about one inch for convenience when using the imperial measurement system.

Referring back to FIGS. 2–4, one advantage of the thermal insulation pad 20 will be described with the aid of these drawings. As can be appreciated, the top cover strip 30 encloses the compressible insulation strip 28 completely and is anchored to both sides of the wall framing member 54, as previously explained, thereby forming an elongated cushioned liner 90 extending around and inside the wall opening 24. The top cover strip 30 is in tension for being attached to both sides of the framing member 54 and stretched by the compressible insulation strip 28 thereunder.

Because of this tensioning of the top cover strip 30 from the compressible insulation strip, the top cover strip 30 does not tend to wrinkle, grab or tear when the window or door frame is slid thereon. The top cover strip 30 flexes smoothly as illustrated at label 92 in FIG. 2 ahead of the window or door frame 26 being slid thereon. The compressibility of the insulation strip 28 and the wrinkle free surface of the top cover strip 30 provide a cushioning characteristic which facilitates the sliding of a window or door frame in a wall opening. After this installation, the compressed insulation strip 28 provides a positive sealing of the gap space 22 between the window or door frame 26 and the wall opening 24.

Figure 8:
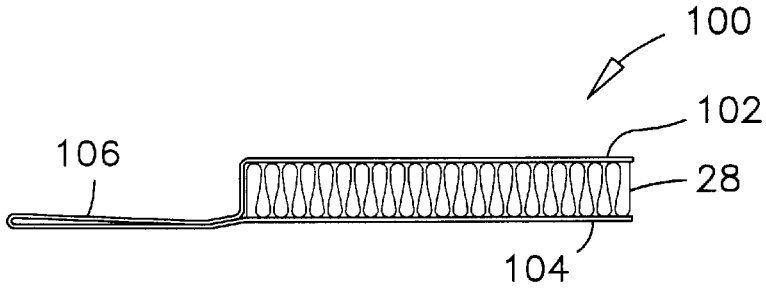
FIG. 8 is the end view of the thermal insulation pad according to the second preferred embodiment.

Referring now to FIG. 8, there is illustrated therein a thermal insulation pad 100 according to the second preferred embodiment of the present invention. In this second preferred embodiment, the compressible insulation strip 28 is only partly enclosed by a top cover strip 102 and a bottom cover strip 104. Both cover strips are made of strong weather resistant construction paper such as previously described, and jointly extend along one side of the insulation strip 28 to form a stapling flange 106. It will be appreciated that in use, when the stapling flange 106 is affixed to the outside surface of a wall, the top cover strip 102 is subjected to tensioning forces when a window or door frame is slid thereon. These tensioning forces provide to a certain extent, the advantages as previously described in guiding a window or door frame 26 thereon without wrinkling, grabbing or tearing.

Several features of the first preferred embodiment 20, such as a bead of caulking, cutting lines or an end flap may be provided on this second preferred embodiment 100 to obtain the advantages as previously described.

Figure 9:
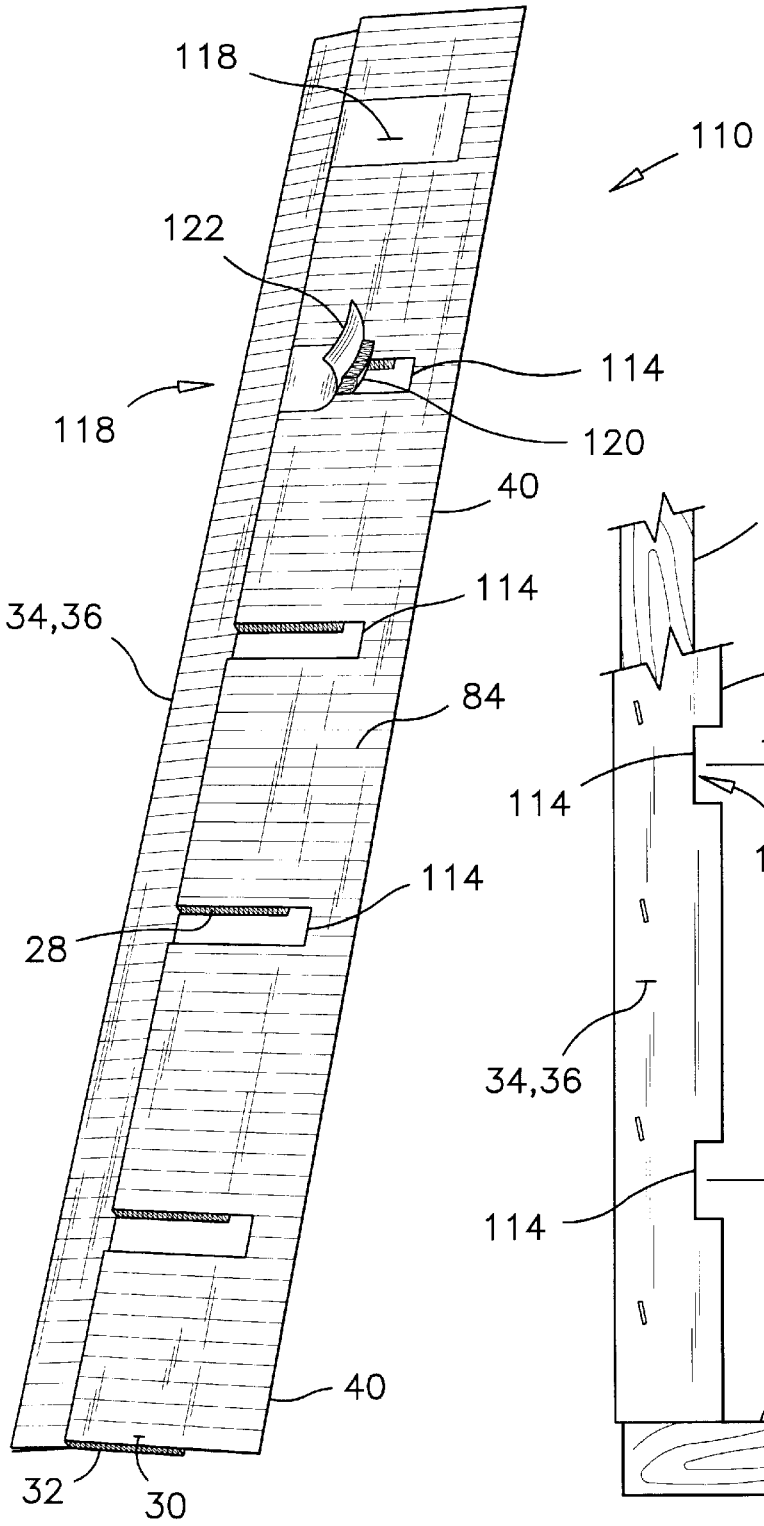
FIG. 9 is a perspective top view of the thermal insulation pad according to the third preferred embodiment.
Figure 10:
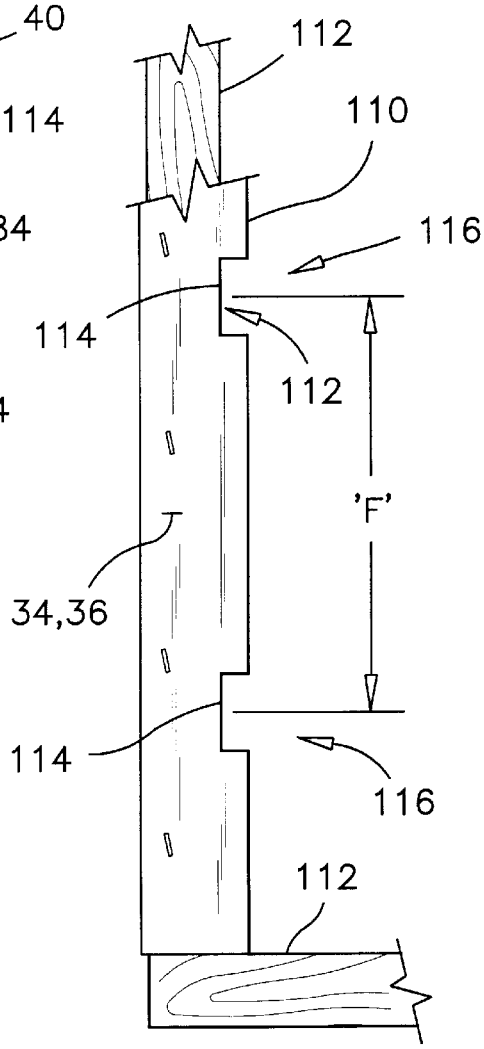
FIG. 10 is a partial side view of a door frame in which the thermal insulation pad according to the third preferred embodiment is mounted.

Referring now to FIGS. 9 and 10, the thermal insulation pad 110 according to the third preferred embodiment is illustrated therein. This thermal insulation pad has a length corresponding to the inside height in a wall opening 112 adapted to receive a door frame. This thermal insulation pad 110 has transverse notches 114 therein where both the top and bottom cover strips 30, 32 are cut out between the stapling and flashing flanges 34, 36, and the interior flange 40. Each transverse notch 114 extends the full depth of the insulation strip 28. Otherwise, the thermal insulation pad 110 according to the third preferred embodiment is constructed in a similar manner as the thermal insulation pad 20 according to the first preferred embodiment, and may have all the features of this first preferred embodiment.

The purpose of the transverse notches 114 is to provide shimming pockets 116 which extend down to the surface of the framing member 112, for shimming a door frame for example. The notches 114 are preferably spaced apart such as to provide shimming pockets under the hinges of a door. For example, a thermal insulation pad 110 for a 79 inch door would have a first notch 114 at 9-½ inches from the lower end thereof, and at every 15-½ inches thereafter, as shown by label 'F'. This notch spacing provides shimming pockets 116 behind a set of hinges spaced at a conventional spacing of 31 inches.

Similar notches 114 can be precut into the thermal insulation pads according to the first or second preferred embodiments for accommodating shims, latches, tie straps, etc in the gap space 22. The pockets 116 formed by the transverse notches 114 are insulated in a conventional manner with loose insulation after the installation of the door or window in the wall opening.

When the thermal insulation pad 110 is sold as a general purpose door insulation product wherein a quantity of shim pockets 116 and pocket spacings are provided for a variety of door sizes and weights, some or all of the transverse notches 114 are preferably covered by patches 118 and exposed only if needed. The preferred patch 118 consists of a plug 120 of compressible insulation material affixed to a flexible tape material 122 having peeled-off adhesive properties. The flexible tape 122 is removably bonded to the top covering strip 30, covering a respective notch 114 completely without discontinuity in the insulation material 28.

As to other manner of usage and operation of the present invention, the same should be apparent from the above description and accompanying drawings, and accordingly further discussion relative to the manner of usage and operation of the invention would be considered repetitious and is not provided.

While one embodiment of the present invention has been illustrated and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

I claim:

1. A thermal insulation pad for insulating a gap space between a window or door frame and a wall opening, said thermal insulation pad comprising:

a compressible insulation strip having a rectangular cross-section, a length, a width, a top surface and a bottom surface, a first and second opposite sides defining said width, and a thickness;

a top cover strip covering said top surface;

a bottom cover strip covering said bottom surface;

a stapling flange extending widthwise from said bottom cover strip, from said first side, and a flashing flange extending widthwise from said top cover strip, from said first side, and extending in a spaced-apart relationship with and over said stapling flange;

said stapling flange and said flashing flange being bonded to each other along a bond line adjacent said compressible insulation strip; said stapling flange and said flashing flange extending away from said bond line; said bond line constituting a seal to prevent an infiltration of moisture into said insulation strip.

2. The thermal insulation pad as claimed in claim 1, further comprising an interior flange extending widthwise from said top cover strip, from said second side.

3. The thermal insulation pad as claimed in claim 2, wherein said top cover strip, said flashing flange and said interior flange extend lengthwise beyond said length and jointly define an end flap.

4. The thermal insulation pad as claimed in claim 1, wherein said top and bottom cover strips are made of strong weather-resistant paper.

5. The thermal insulation pad as claimed in claim 2, wherein said top cover strip, said flashing flange and said interior flange have transverse lines printed thereon.

6. The thermal insulation pad as claimed in claim 1 wherein said stapling flange has a strip of adhesive thereon.

7. The thermal insulation pad as claimed in claim 2, wherein said interior flange has a strip of adhesive thereon.

8. The thermal insulation pad as claimed in claim 1, wherein said flashing flange has a bead of caulking and a peeled-off protective paper strip thereon.

9. The thermal insulation pad as claimed in claim 1, wherein said bond line has a width of about ½ inch.

10. The thermal insulation pad as claimed in claim 1, wherein said insulation strip is made of fibreglass insulation.

11. The thermal insulation pad as claimed in claim 1, wherein said width is about 5-/2 to 6 inches, and said thickness is about ¾ of an inch.

12. The thermal insulation pad as claimed in claim 1, wherein said stapling flange and said flashing flange extend from said bottom cover strip and said top cover strip respectively, a distance of about 1½ to 2 inches.

13. The thermal insulation pad as claimed in claim 2, wherein said interior flange extends from said top cover strip over a distance of about 1½ to 2 inches.

14. The thermal insulation pad as claimed in claim 1, further comprising a transverse notch in said top cover strip and said insulation strip for defining a shim pocket in said gap space.

15. A thermal insulation pad for insulating a gap space between a window or door frame and a wall opening, said thermal insulation pad comprising:

a compressible insulation strip having a rectangular cross-section, a length, a width, a top surface and a bottom surface, a first and second opposite sides defining said width, and a thickness;

a flexible top cover strip covering said top surface;

a flexible bottom cover strip covering said bottom surface;

a stapling flange extending widthwise from said bottom cover strip, from said first side, continuously along said length;

a flashing flange extending widthwise from said top cover strip, from said first side, continuously along said length, and a plurality of spaced-apart empty spaces in said insulation strip and said top cover strip wherein each of said empty spaces is defined between said first and second sides.

16. The thermal insulation pad as claimed in claim 15, further having patches removably covering at least some of said empty spaces.

17. In combination, a wall having a wall thickness, an outdoor surface, an indoor surface and a wall opening therein, and a thermal insulation pad circling said wall opening, said thermal insulation pad comprising:

a compressible insulation strip having an insulation thickness, a rectangular cross-section, a width substantially similar to said wall thickness a top surface and a bottom surface, and a first and second opposite sides defining said width said width extending perpendicular to a plane of said wall opening;

a flexible top cover strip covering said top surface;

a flexible bottom cover strip covering said bottom surface;

said flexible top cover strip having a flashing flange extending widthwise therefrom, from said first side, and an interior flange extending widthwise therefrom, from said second side;

said flashing flange being affixed to said outdoor surface and said interior flange being affixed to said indoor surface and said flexible top cover being stretched over said compressible insulation strip, and defining a perimeter of said wail opening.

18. The combination as claimed in claim 17, wherein said wall further comprises a weather and air barrier on said outdoor surface and said thermal insulation pad further has a stapling flange extending widthwise from said bottom cover strip, from said first side, and said weather and air barrier being partly enclosed between said stapling flange and said flashing flange.

19. The combination as claimed in claim 18, wherein said wall further comprises a vapour barrier on said indoor surface, and said interior flange partly overlaps said vapour barrier.

20. The combination as claimed in claim 18, wherein said flashing flange and said stapling flange being sealed to each other along a bond line extending along said first side of said compressible insulation strip.

* * * * *